US005452964A

United States Patent [19]

Trougouboff

[11] Patent Number: 5,452,964

[45] Date of Patent: Sep. 26, 1995

[54] BARRIER FOR THE PROTECTION OF RESERVED AREAS AGAINST THE INTRUSION OF MOTOR VEHICLES

[76] Inventor: Emile Trougouboff, 15Bis, avenue de Curti, Saint Maur des Fosses, 94100, France

[21] Appl. No.: 162,113

[22] PCT Filed: Jun. 12, 1992

[86] PCT No.: PCT/FR92/00531

§ 371 Date: Mar. 7, 1994

§ 102(e) Date: Mar. 7, 1994

[87] PCT Pub. No.: WO92/22709

PCT Pub. Date: Dec. 23, 1992

[30] Foreign Application Priority Data

Jun. 13, 1991 [FR] France ..... 91 07220

[51] Int. Cl.[6] ..... E01F 9/017; E01F 13/04

[52] U.S. Cl. ..... 404/10; 404/11; 49/35; 49/49

[58] Field of Search ..... 404/6, 9, 10, 11; 49/35, 49, 131

[56] References Cited

U.S. PATENT DOCUMENTS 3,417,508 12/1968 Sprung ..... 49/35

5,215,400 6/1993 Hugron ..... 404/11

FOREIGN PATENT DOCUMENTS 2622614 5/1989 France ..... 404/6

2634235 1/1990 France ..... 49/49

*Primary Examiner*—Ramon S. Britts

*Assistant Examiner*—James A. Lisehora

*Attorney, Agent, or Firm*—Lane, Aitken & McCann

[57] ABSTRACT

A barrier for the protection of reserved areas including at least one upper element (1) rotatably mounted relative to a lower element (6) anchored in the ground (G). An elastic return spring (18) is interposed between the upper and lower elements (1,6). The upper element (1) is adapted to be displaced to either side of an upright reference position by rotating about a horizontal pin (2) provided on the lower element (6). A releasable mechanism selectively blocks rotation of the upper element in a first direction (F2) and a non-releasable mechanism blocks rotation of the upper element in the reverse direction (F1) at the end of a limited angular deflection. The elastic return spring provides a force opposing the limited deflection in the reverse direction.

11 Claims, 6 Drawing Sheets

BARRIER FOR THE PROTECTION OF RESERVED AREAS AGAINST THE INTRUSION OF MOTOR VEHICLES

BACKGROUND OF THE INVENTION

1. Field of the Invention

The present invention relates to barriers for the protection of reserved areas against intrusion by motor vehicles.

2. Description of the Prior Art

"Reserved areas" are to be taken to mean areas for the parking of private vehicles, or so-called individual parking spaces, conferring upon their owners a right of private use, or areas for circulation intended for the sole use of pedestrians or authorized vehicles, such as pavements, avenues, alleys or lanes, for example. In such cases, protective barriers are provided to prevent access to these areas by all unauthorized vehicles. "Reserved areas" are also to be taken to mean surface areas occupied by trees, posts of the signpost type, poles carrying carrying electric cables, telephone poles, telegraph poles, pylons and the like and, in these cases, the said barriers are specially designed and located so as to prevent any damage resulting from shocks or bumps caused by machines, vehicles or others.

Thus, for example, in the case of indivual parking spaces or entries to private roads or drives, these barriers generally take the form of devices firmly anchored in the ground which are able to occupy two extreme positions, namely: an upright position and a lying position. The upright position corresponds to the position preventing access to the reserved area by any vehicle, while the lying position permits such access. These two positions are attained as a result of pivotal movements imparted to the said devices, and they can be blocked using any appropriate means so as to prevent an external event or an authorized party from modifying them. The owners of private parking spaces thus have at their disposal locking or blocking means giving them alone the ability to operate the said barriers. However, it frequently happens that these devices are subjected, deliberately or unintentionally, to shocks and that, as a result, they are damaged to the extent of becoming unusable and of having to be removed and replaced, which involves quite a substantial investment. The same applies to barriers designed for the protection of trees, posts and the like, which barriers are placed around these trees or posts so as to form obstacles preventing their damage by violent bumps or shocks.

SUMMARY OF THE INVENTION

The present invention aims to avoid these drawbacks and to enable these devices to withstand or absorb shocks without this necessarily resulting in the need to proceed to the said removal and replacement.

For this purpose, the invention provides a barrier comprising at least one vertical element pivotally mounted on a sole anchored in the ground, and characterized by the arrangement, between the said sole and the said vertical element, of an elastically deformable means having at least one spring extending between a terminal zone integral with the said sole and a zone engaging with the said element.

Such an elastically deformable means can easily be designed, on one hand to absorb any shocks or thrusts, the whole resisting passage across this element by any vehicle without the latter sustaining damage and, on the other hand, to bias the said element back to its normal protective position.

According to one possible form of embodiment suitable for barriers to protect individual parking spaces or reserved circulation areas, the said element articulated at its base consists of a post and acts against the said elastically deformable element with which it is associated when it is biassed in the direction opposite that of normal swinging towards a lowered rest position, and a means is provided for limiting the amplitude of the deflection resulting from this biassing;

the base of the said articulated element is rotationally mounted about a horizontal pin, the ends of which form pivots supported by bearings provided in a shoe or housing borne by the sole that is to be anchored in the ground, and this same base is adapted to act directly in compression upon a spring provided on the said sole when a thrusting force is exerted in the direction opposite that bringing the said post into its normal lowered position;

the height of the assembly in raised position is adapted to remain greater than the height in relation to the ground of the chassis of a vehicle to be parked in the parking space or able to use the reserved circulation area the entry to which it defends.

According to another possible form of embodiment, the said element articulated at its base consists of a post on the upper portion of which are provided loop-like members projecting laterally and arranged in the same plane, the bases of these loop-like members being connected to the said post via springs.

In one form of embodiment suitable for constituting a protective barrier for trees, pylons or the like, the said element consists of a post articulated at its base and capable of swinging in all directions, the said elastically deformable element being formed by at least one coil spring extending between a terminal zone integral with the said base and a complementary zone engaging with the said post.

According to one possible form of embodiment, the said post comprises, laterally, projecting elements forming substantially the arc of a circle to encircle the tree, pylon or the like partially or entirely.

BRIEF DESCRIPTION OF THE DRAWINGS

Further characteristics and advantages of the invention will emerge more clearly from the following description, provided with reference to the annexed drawings, wherein.

DESCRIPTION OF THE PREFERRED EMBODIMENTS

Figure 1:
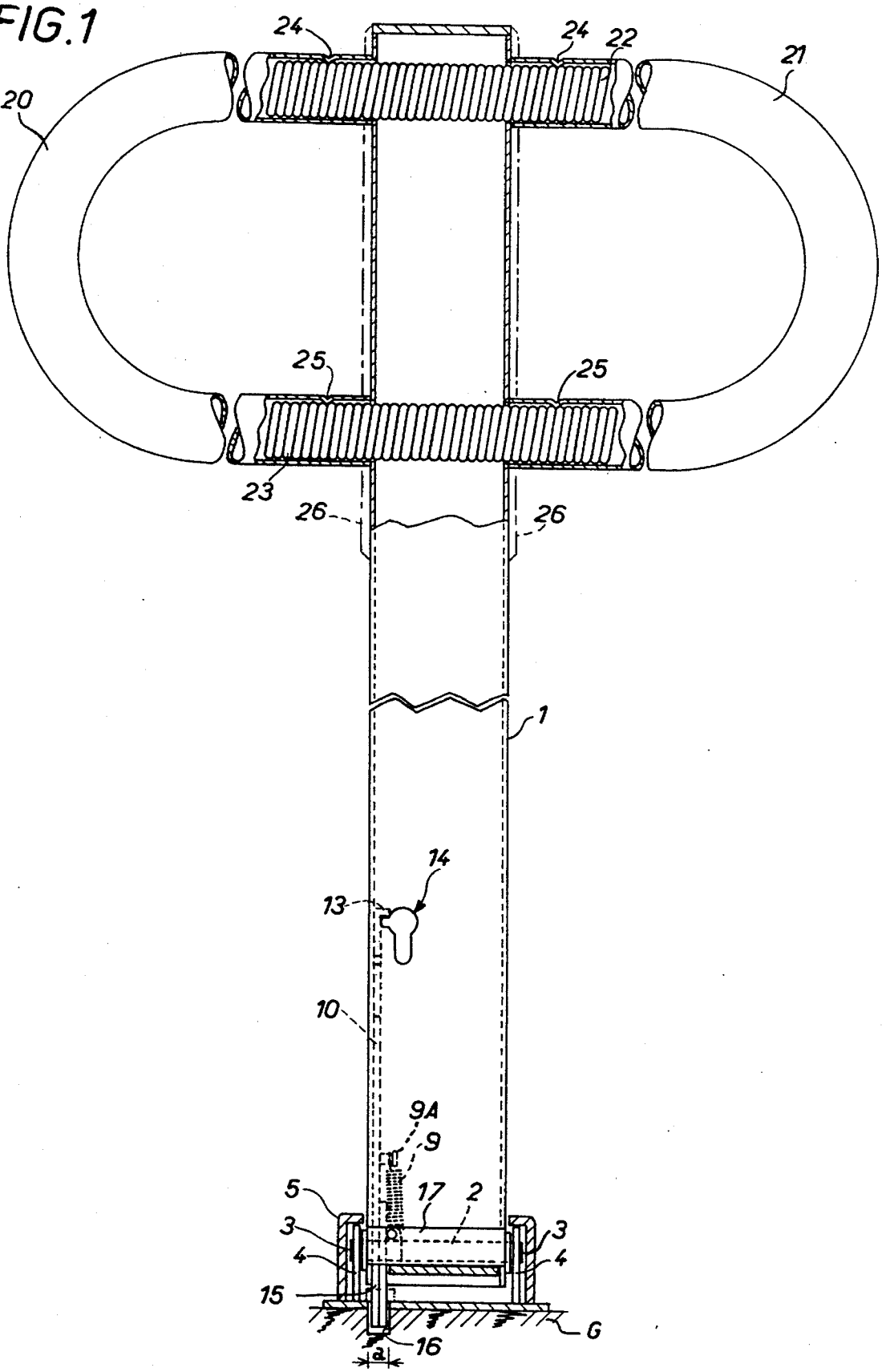
FIG. 1 is a front cross-sectional and elevation view of an example of an improved barrier according to the invention in a raised position.
Figure 2:
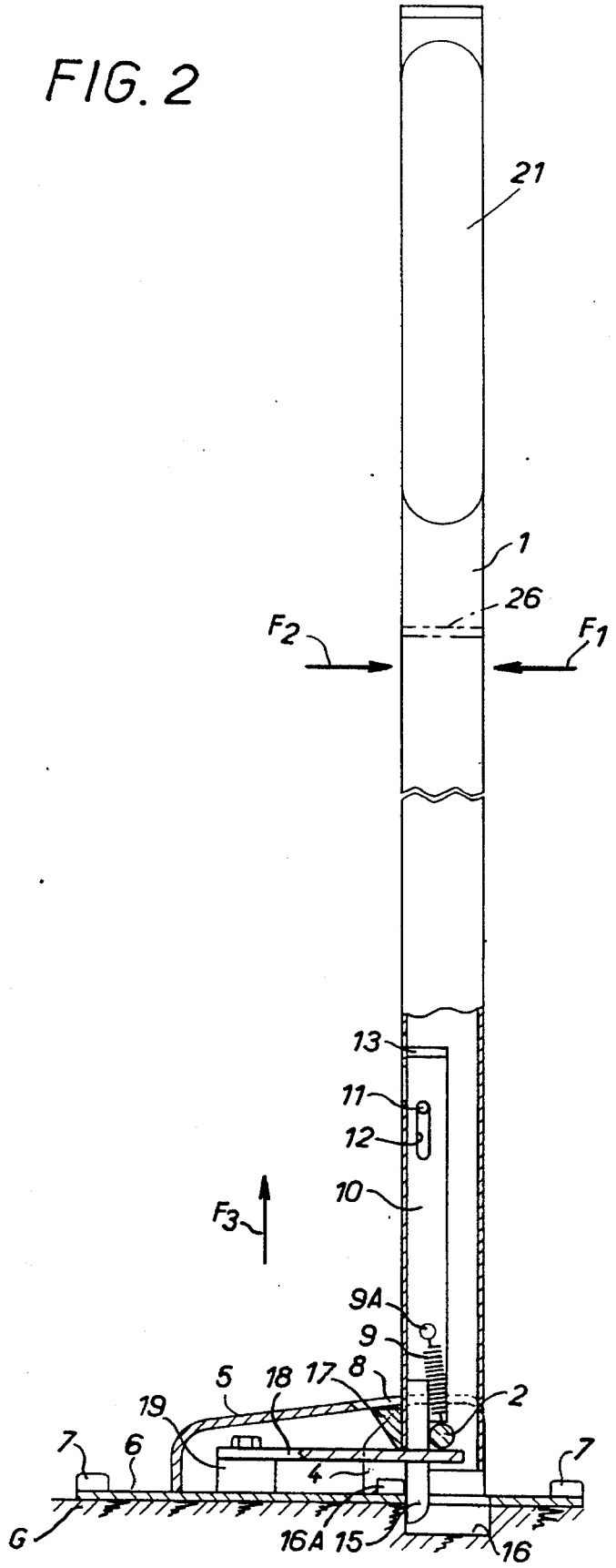
FIG. 2 is a side view.

According to the first chosen form of embodiment, shown in FIGS. 1 to 4, a barrier according to the invention is constituted by an upright 1 having the form of a metallic post with a rectangular cross-section. Through the base of this post passes a cylindrical part 2, the ends 3 of which form journals borne by bracket-bearings 4. This assembly can be received in a housing 5. The latter is welded to a sole , which is firmly anchored in the ground G, for example by bolts 7. The upper portion of the housing 5 comprises a recess 8 for angular deflection of the post 1 between a raised (vertical) position illustrated in FIGS. 1 and 2, and a lying position, illustrated in FIG. 3. A return spring 9 is attached between pin 2 and a stud 9A provided for this purpose on a slide 10 mounted in post 1 with liberty of translation parallel to the longitudinal axis of the post limited by a stud and slot coupling 11–12 formed by the stud 11 borne by the said post 1 and the slot cut out in the slide 10. The upper portion of the latter ends in a hook, handle or nose 13 which can be immobilized in a desired position thanks to a key operated system schematically represented at 14 (FIG. 1), which can be of any known type or designed as illustrated and described hereinafter with reference to FIGS. 5 to 7. As to the lower portion of the said slide, this is extended by an elongated part 15 playing the part of a bolt designed to cooperate with a striking box, formed here by a cavity 16 hollowed out in the ground and opening into sole 6. The width (a) of this cavity corresponds substantially to the width of the said part 15, while its length is established according to the maximum deflection that is allocated to the post 1 in the event of a thrust in the direction of arrow F1 (FIGS. 2 and 4), as will be seen below.

Furthermore, the vicinity of the lower portion of post 1 comprises a piece in the form of a heel 17 designed to cooperate with a leaf spring 18 possessing high bending strength mounted on plate 6 via a shoe 19 and bolted (or welded) to the said plate.

Figure 3:
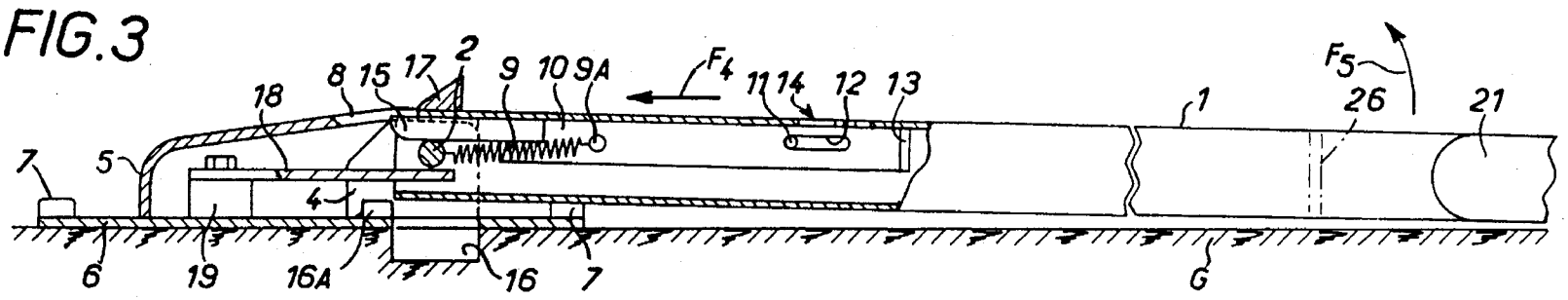
FIG. 3 is a view corresponding to FIG. 2, the barrier being in a lying position.

With such an assembly, it will be noted immediately that if, after acting on key operated system 14, slide 10 is pulled upwards, bolt 15 is removed from cavity 16 in which it was previously engaged, which enables post 1 to be swung in the direction of arrow F2 to cause it to occupy the lying position illustrated in FIG. 3. In this position, it will be noted that return spring 9 has been extended as a result of the translation movement performed by slide 10 in the direction of arrow F3 up to the position at which the lower end of slot 12 comes into abutment against stud 11. The assembly can remain held in this spring tensioning position by means of the key operated system 14. To return to the upright position illustrated in FIGS. 1 and 2, it suffices to release slide 10, so that, through the action of spring 9, it is biassed in the direction of arrow F4. In the raised position, illustrated in FIGS. 1 and 2, the bolt 15 then drops back into striking box 16, and it can be locked in this position by means of the lock formed by the key operated system 14. The assembly bears on the wall of cavity 16 and on a stop 16A provided on the sole 6 as an extension of the said wall.

It is also possible to release the slide by allowing spring 9 to become slack when the post is in the lying position: during the movement of raising to the upright position, bolt 15 can come into contact with the upper face of stop 16A, but it can be raised without difficulty by exerting tension on spring 9 until it arrives opposite the striking box, into which it will drop automatically through the effect of the release of the said spring.

Figure 4:
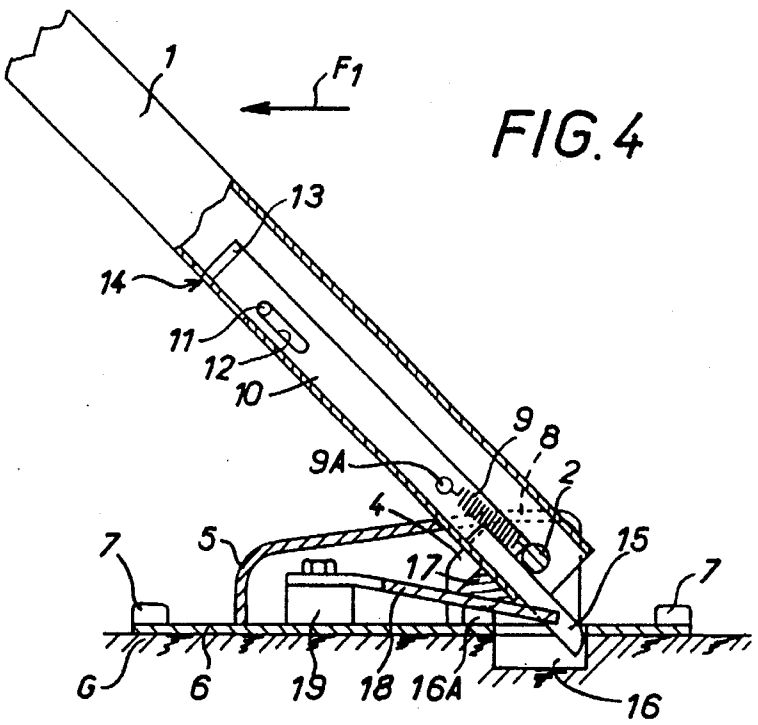
FIG. 4 is a view corresponding to FIG. 2, the barrier being in an extreme position possible through the effect of an antagonistic thrust.

If, in the upright position, post 1 is subjected to thrust or to a shock (arrow F1) in the direction opposite that tending to bring it into the lying position (arrow F2), heel 17 bears heavily on leaf spring 18, which yields, while absorbing the force applied. To limit the deflection of the post under the effect of such thrust, two elements will act as stop means, namely the full bearing of heel 17 on leaf spring 18, on one hand, and the abutment of bolt 15 on the transverse wall of striking box 16 which is opposite its normal bearing position. Forcible entry of the parking area as a result of the post swinging fully in the direction of thrust F1 is thus prevented. Such a limitation of swing has the effect of leaving mechanical parts above ground level at a height at least equal to the height of the chassis of a vehicle in relation to the ground; consequently, there is a risk of collision and damage to a vehicle attempting to force its way through. That is why the post in question will be designed to have a height such that, even when inclined at an angle of 45°, for example (as illustrated in FIG. 4) this chassis height is maintained.

The above description relating to the design of the lower portion of a parking area barrier brings out, as it is, the advantage and value of the improvement thus made. A post that has been subjected to stress or a shock can return to its initial raised position and continue to play its role as a means of protection against an unauthorized access attempt, without necessitating systematic replacement.

This improvement is complemented by the improvement also made to the upper portion of a barrier of the post type such as the one described above and comprising, laterally and so as to project, elements constituting the desired space occupying volumes or surfaces.

In the form of embodiment illustrated here, these space occupying volumes or surfaces are represented by two lateral loop-like members 20, 21. These loop-like members can be produced using any material, preferably tubular and, according to the invention, they are connected to post 1 via sections of appropriate lengths of helicoidal springs 22 and 23 passing freely right through the said post. A portion of these springs fits into tubular elements 20 and 21, and they are secured by crimped points such as 24, 25. To complete such an assembly, reinforcing plates, such as 26 can be provided, these being, for example, welded or riveted.

Thanks to such an arrangement, any shock or thrust applied to the loop-like members results in yielding, generally preventing any damage liable to necessitate replacement of the barrier.

It can thus be seen that a barrier according to the invention receiving a shock or being subjected to frontal or lateral thrust is able to withstand and absorb this shock or thrust without damage, given the flexibility and ability to be deformed without damage imparted to the barriers according to the invention equipped with the means described.

According to one possible form of embodiment, cavity 16 can be dispensed with by causing part 15 to end at the sole 6, part 16, possibly raised, sufficing to serve it as a stop.

Further, for greater convenience of use, lock 14 can be placed at the top of post 1. An advantageous form of embodiment implementing such developments will be described hereinafter, with reference to FIGS. 5 to 7.

These FIGURES show: a post 1A, a sole 6A, a housing 5A, a pivot pin 2, a leaf spring 18A, bolts 7 for securing the sole in ground G, recess 8, return spring 9, slide 10A with the end portion 15 forming a bolt, and stop 16A. A lock 27, provided at the top of the post forms a security assembly (to be described hereinafter) above two lateral loop-like members 20, 21, again equipped with their springs 22, 23 passing through the said post 1 and their crimped points 24, 25.

In this form of embodiment, the need for a striking box hollowed out in the ground is avoided. Furthermore, the yielding of leaf spring 18A is obtained, here, in the event of thrust being exerted in the antagonistic direction of arrow F1, by providing at the lower end of post 1 a curved back bearing segment 17A to play the part of supporting heel 17 in the variant described previously.

Figure 5A:
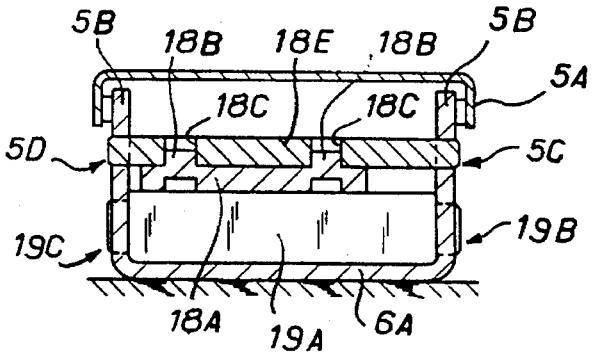
FIG. 5A is a cross-sectional view along line VA—VA of FIG. 5.

Simplification of the design is also to be found in the ease with which the leaf spring can be mounted and assembled, in that this spring is held at one of its ends by a device that is simple and easy to produce and mount: in the vicinity of one of the ends, leaf spring 18 has two studs, 18B, 18B (FIG. 5A) designed to be inserted in matching recesses 18C, 18C provided in a part 1BE supported by lateral walls 5B, 5B by a tenon and mortise type system identified as 5C–5D. This leaf spring rests, furthermore, on a cross member 19A of the sole, also inserted between walls 5B, 5B by the same means of the tenon and mortise type, 19B–19C. The lateral walls 5A, 5B are in one piece, here, with sole 6A, which represents a further simplification avoiding any need for welding in the housing.

Figure 5:
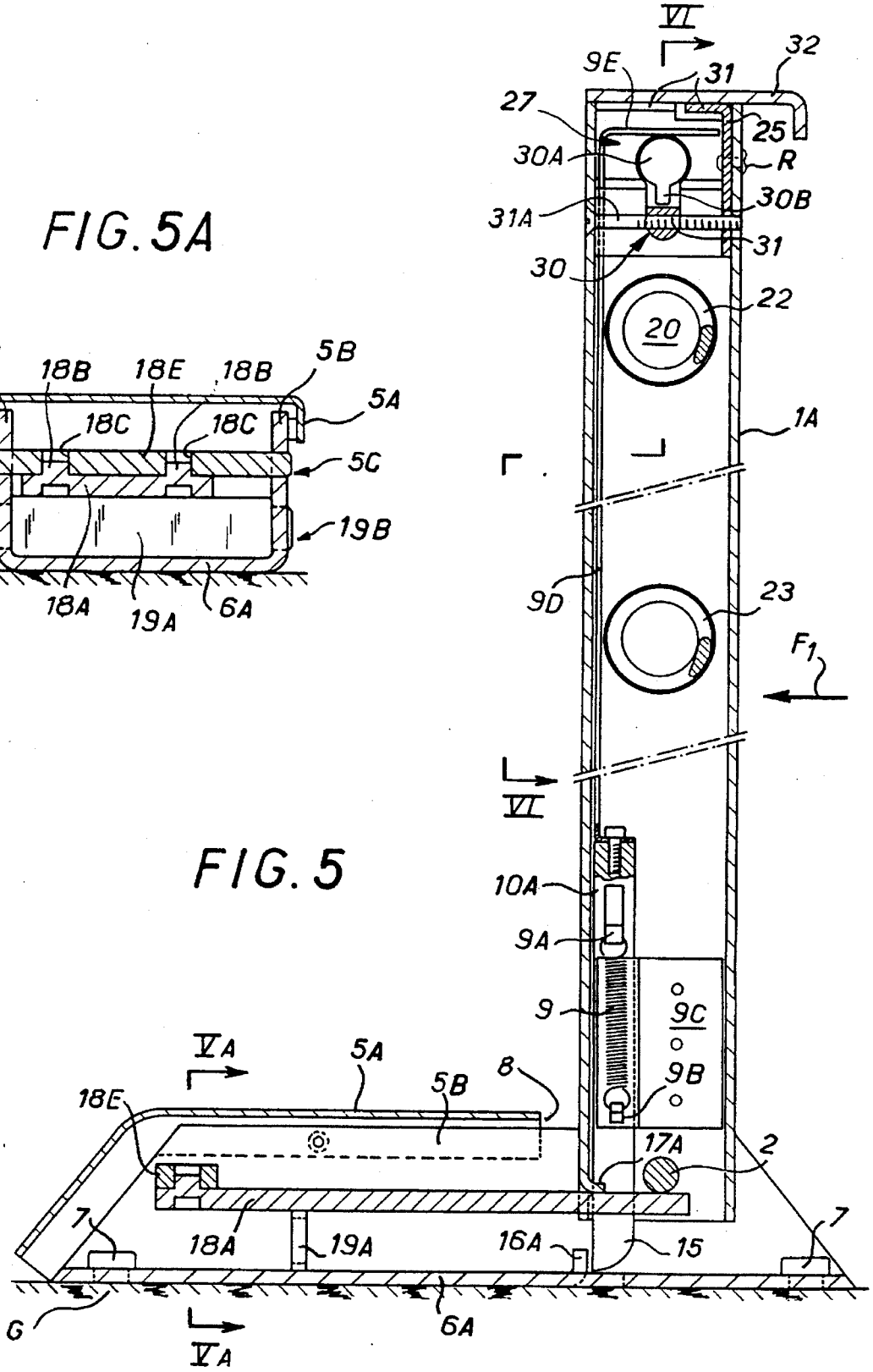
FIG. 5 is a view analogous to that of FIG. 1, illustrating a variant.
Figure 6:
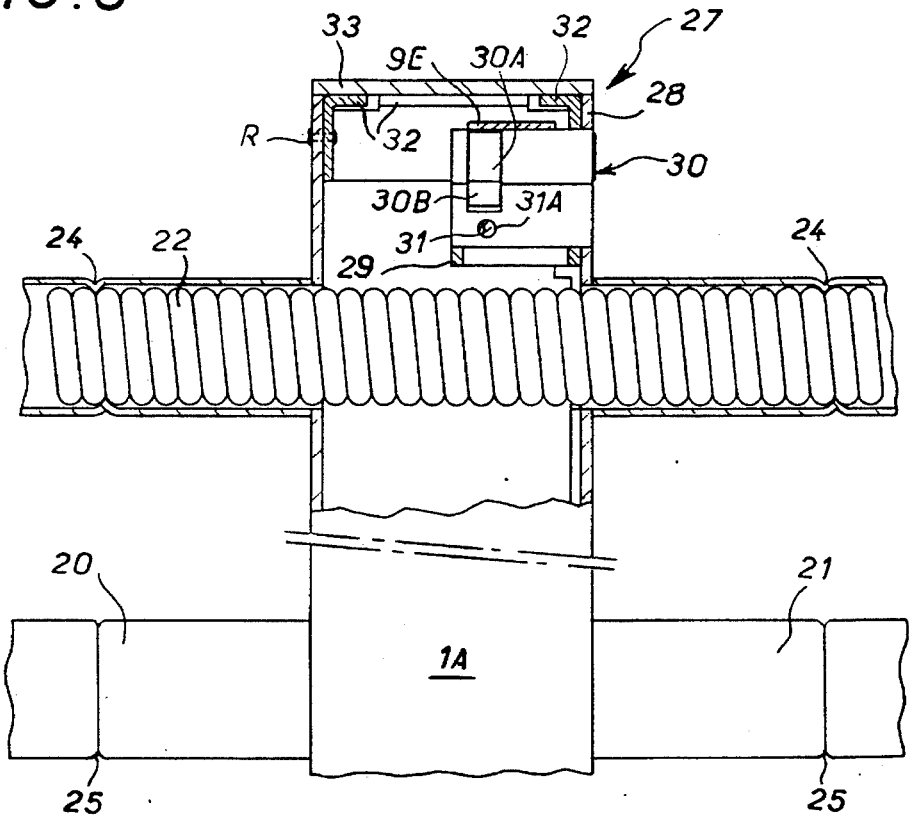
FIG. 6 is a cross-sectional view along line VI—VI of FIG. 5.
Figure 7:
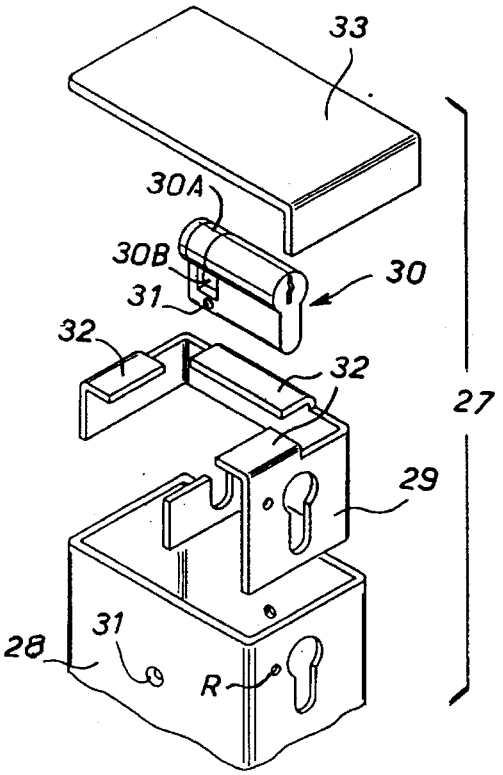
FIG. 7 is an exploded perspective view of the constituent elements of the device featuring in the upper portion of FIGS. 5 and 6.

Further security is obtained thanks to the fact that the lock system is mounted at the top of the post (see FIGS. 5, 6 and 7). In this case, slide 10A to which is secured the upper end of return spring 9 (at 9A) is attached to lock 14 by a rod 9D ending in a hook shaped element 9E to which upward traction can be applied as before. Slide 10 forming bolt 15 is guided here by a plate 9C fixed to an inner face of post 1 with a raised marginal portion to ensure the said guiding and a hook 9B being formed at the bottom of this raised portion to engage the lower end of return spring 9.

Lock 27 (see FIG. 7) is installed in an area set aside for this purpose at the top of post 1 via a fitted housing 28 fixed by riveting. The lock itself, located inside the said housing, is rendered practically impregnable owing to the S fact that, into housing 28 receiving the rivets at R is fitted the barrel holder 29 in which barrel 30 is mounted by a screw 31 passing through it at 31A. This barrel holder has flats 32 adapted to be flush with the upper edge of the post and to be secured by welding to a cover 33 forming a protective plate. It will be appreciated that, mounted as it is, this lock affords no opportunity of dismantling it to gain access to the slide manoeuvering means, save by fracturing the entire upper portion inside which the said lock is housed. The turning of a key causes the rotation of a tooth (30B) on mobile portion 30A of the barrel which acts to raise, for example, catch 9E and, as a result, slide 10.

Figure 9:
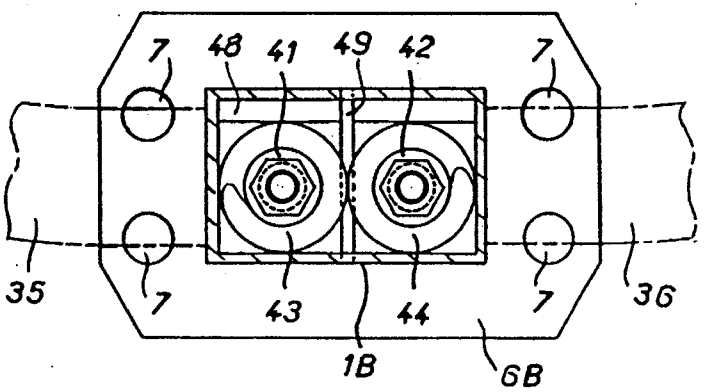
FIG. 9 is a plan view along line IX—IX of FIG. 8.
Figure 10:
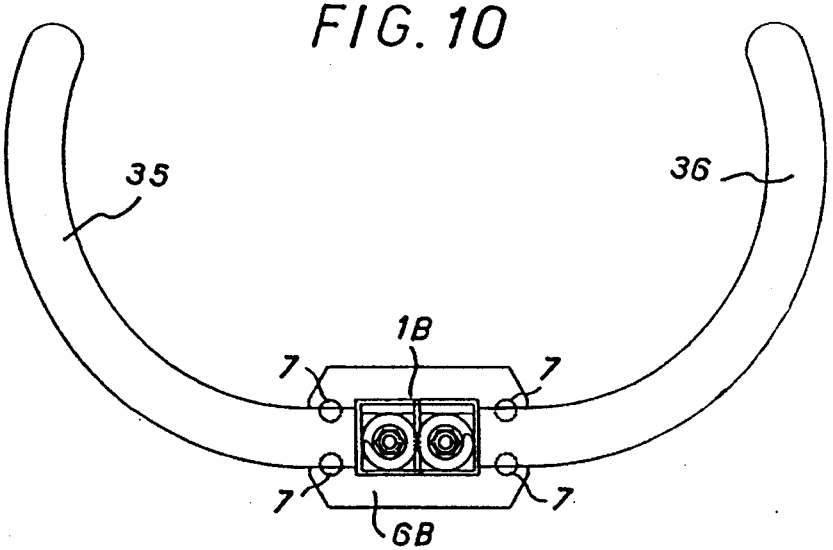
FIG. 10 is a plan view, on a smaller scale, of a variant of the barrier as a whole.
Figure 8:
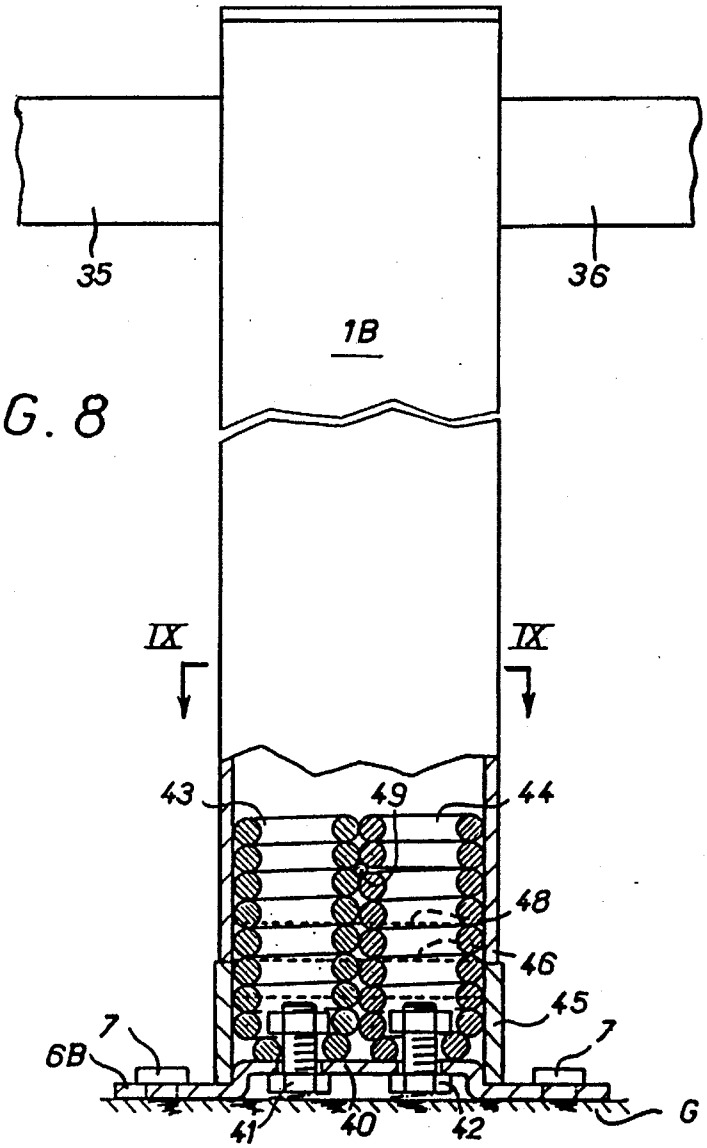
FIG. 8 is an elevational view of a variant of a barrier according to the invention.

With reference now to FIGS. 8 to 10, these show a variant of the invention suitable for the protection of trees, posts and the like. A hollow post having a rectangular cross-section 1B is borne by a sole 6B, bolted to the ground G at 7.

This sole 6B has here a raised central portion 40, through which pass two anchor bolts 41, 42, each of them being adapted to make integral with the sole the lower end portion, shaped for this purpose, of a helicoidal spring 43, 44 of appropriate strength and dimensions.

The lower portion of these juxtaposed springs, which portion is confined to a few turns, is capped by the force fitting of a base 45 formed by a section of tubular bar the shape of which is similar to that of the bar forming post 1B; this fit is reinforced by a wedge 47. The post 1B itself is force fitted over the upper complementary portion of springs 43, 44 which emerges from base 45. this second fit is reinforced by a wedge 48 and by a locking pin 49 jammed between the two springs.

It will be appreciated, then, that, with such an assembly, any shock, whatever its direction, will result in an elastic reaction by the post, which will swing about the base 45, while absorbing the energy of impact through the deforming work of springs 43, 44 and the friction accompanying this deformation. Protection can be completed by providing, as in the case of the variant described previously, lateral projecting members such as 35–36 which can be made of suitable materials, have suitable dimensions and be of an enveloping shape, for example an arc shape, as illustrated in FIG. 10. This shape is suitable, as will be readily appreciated, for the protection of elements such as trees, pylons, posts and the like. If really necessary, the ends of these arc shaped projecting members can come together to encircle these elements entirely and, in this case, they can have, in particular at their point of attachment to the post, a degree of elasticity suitable for facilitating their installation.

It goes without saying that the description of the present invention has been provided solely by way of illustration and is in no way limitative, and that any appropriate modification could be made thereto without thereby departing from its scope. One essential advantage of the invention remains, in any case, the fact that elastic deformation occurring at the time of impact ensures that the sealing system formed in a single block (reference G in the drawings) is not torn out, which is, indeed, a risk in the case of the rigid systems of the prior art.

I claim:

1. A barrier for the protection of reserved areas, adapted for resisting shocks and thrusting from motor vehicles, comprising:

a lower element anchored in the ground and including a horizontal pin;

at least one upper element (1) rotatably mounted about said horizontal pin;

an elastic return means (18) interposed between said upper and lower elements (1,6), the upper element (1) being adapted to be displaced in rotation about said horizontal pin (2) to either side of an upright reference position;

a selectively releasable means (15,16) for selectively blocking rotation of said upper element from said upright position in a first direction (F2); and a rigid means (8, 15, 16) for blocking rotation of said upper element in a reverse direction (F1) at the end of a limited angular deflection from said upright position, the elastic return means (18) intervening in the limited deflection by supplying a force opposing the limited deflection.

2. The barrier according to claim 1, characterized in that said upper element is a post (1) and said lower element is a sole (6), said elastic return means comprising at least one leaf spring (18), generally orientated perpendicularly to said horizontal pin (2) and extending between a terminal zone (19) integral with said sole (6) and a zone engaged with said post (1).

3. The barrier according to claim 2, characterized in that said post includes a base which is rotationally mounted about said horizontal pin (2), said base having ends which constitute pivots (3), said sole including a housing (5) providing bearings, said pivots supported by said bearings, and said base being adapted to act directly in compression upon said leaf spring (18).

4. The barrier according to claim 3, characterized in that said releasable blocking means includes a bolt (15) provided at said base and a striking box is provided in the ground, said base cooperating with said striking box (16) and opening into the said sole.

5. The barrier according to claim 4, characterized in that said striking box has a transverse wall and said rigid blocking means includes the abutment of the bolt (15) on said transverse wall.

6. The barrier according to claim 1, characterized in that said upper element includes a base which is rotationally mounted about said horizontal pin (2), said base having ends which constitute pivots (3), said lower element including a housing (5) providing bearings, said pivots supported by said bearings, and said base being adapted to act directly in compression upon said elastic return means (18).

7. The barrier according to claim 6, characterized in that said base comprises a piece in the form of a heel (17) designed to cooperate with said elastic return means.

8. The barrier according to claim 7, characterized in that said rigid blocking means includes the full bearing of said heel (17) on said leaf spring (18).

9. The barrier according to claim 6, characterized in that said housing is provided with a recess having an edge and said rigid blocking means includes the abutment of said post against the edge of said recess.

10. The barrier according to claim 8, characterized in that, when said upper element (1) is at the end of the limited angular deflection, the height of the barrier is at least equal to the height of a chassis of a vehicle in relation to the ground.

11. The barrier according to claim 1, characterized in that said upper element (1) has an upper portion with loop-like members (20, 21) projecting laterally therefrom, said loop-like members connected to said upper element via sections of springs (22,23) passing through said upper element and fitting into said loop-like members.

* * * * *